US008427314B2

(12) United States Patent
Billiard

(10) Patent No.: US 8,427,314 B2
(45) Date of Patent: Apr. 23, 2013

(54) SILENT ANTI-THEFT PROTECTION SYSTEM FOR GOODS PRESENTED TO THE PUBLIC

(75) Inventor: Jean-Pierre Billiard, Luce (FR)

(73) Assignee: SAAA—Systemes d'Automatismes d'Alarmes Automatiques, Gallardon (FR)

( * ) Notice: Subject to any disclaimer, the term of this patent is extended or adjusted under 35 U.S.C. 154(b) by 295 days.

(21) Appl. No.: 12/972,845

(22) Filed: Dec. 20, 2010

(65) Prior Publication Data

US 2011/0175733 A1 Jul. 21, 2011

(30) Foreign Application Priority Data

Dec. 18, 2009 (FR) ..... 09 59208

(51) Int. Cl.
*G08B 13/14* (2006.01)

(52) U.S. Cl.
USPC ..... 340/568.1; 340/568.2; 340/571

(58) Field of Classification Search ..... 340/568.1
See application file for complete search history.

(56) References Cited

U.S. PATENT DOCUMENTS 7,209,038 B1 4/2007 Deconinck et al.
2003/0206106 A1* 11/2003 Deconinck et al. ..... 340/568.2
2007/0194918 A1* 8/2007 Rabinowitz et al. ..... 340/568.2
2007/0229259 A1* 10/2007 Irmscher et al. ..... 340/568.2
2010/0295677 A1 11/2010 Egawa et al.

FOREIGN PATENT DOCUMENTS

DE 197 11 571 A1 10/1998
JP 2009140236 A 6/2009
WO 2007/115097 A2 10/2007
WO 2009/072344 A1 6/2009

OTHER PUBLICATIONS

French Search Report, dated Jul. 12, 2010, in FR 0959208.

* cited by examiner

*Primary Examiner* — Kerri McNally

(57) ABSTRACT

An anti-theft protection system for goods presented to the public includes a set of sensors connected to the goods and linked to a control unit capable of determining states, the states being at least a state of presence of the goods and a state of theft attempt and/or actual theft, the shift from a state of presence of the goods to a state of theft attempt and/or actual theft resulting, in the absence of inhibition of the detection for the sensor, in the control unit being set into alarm, the control unit including or being connected to a sonorous alarm generating elements. The control unit further includes wireless transmission-reception elements and the system further includes at least one portable wireless transmitter-receiver capable of communicating with the control unit, and elements adapted so that, upon setting-into-alarm, the transmission-reception means of the control unit provide for searching for the functional existence of at least one portable transmitter-receiver, during a determined maximum search time thanks to the sending of a search signal. In the absence of response at the end of the determined maximum search time, the control unit activates the sonorous alarm generating elements.

12 Claims, 3 Drawing Sheets

SILENT ANTI-THEFT PROTECTION SYSTEM FOR GOODS PRESENTED TO THE PUBLIC

BACKGROUND OF THE INVENTION

Figure 1:
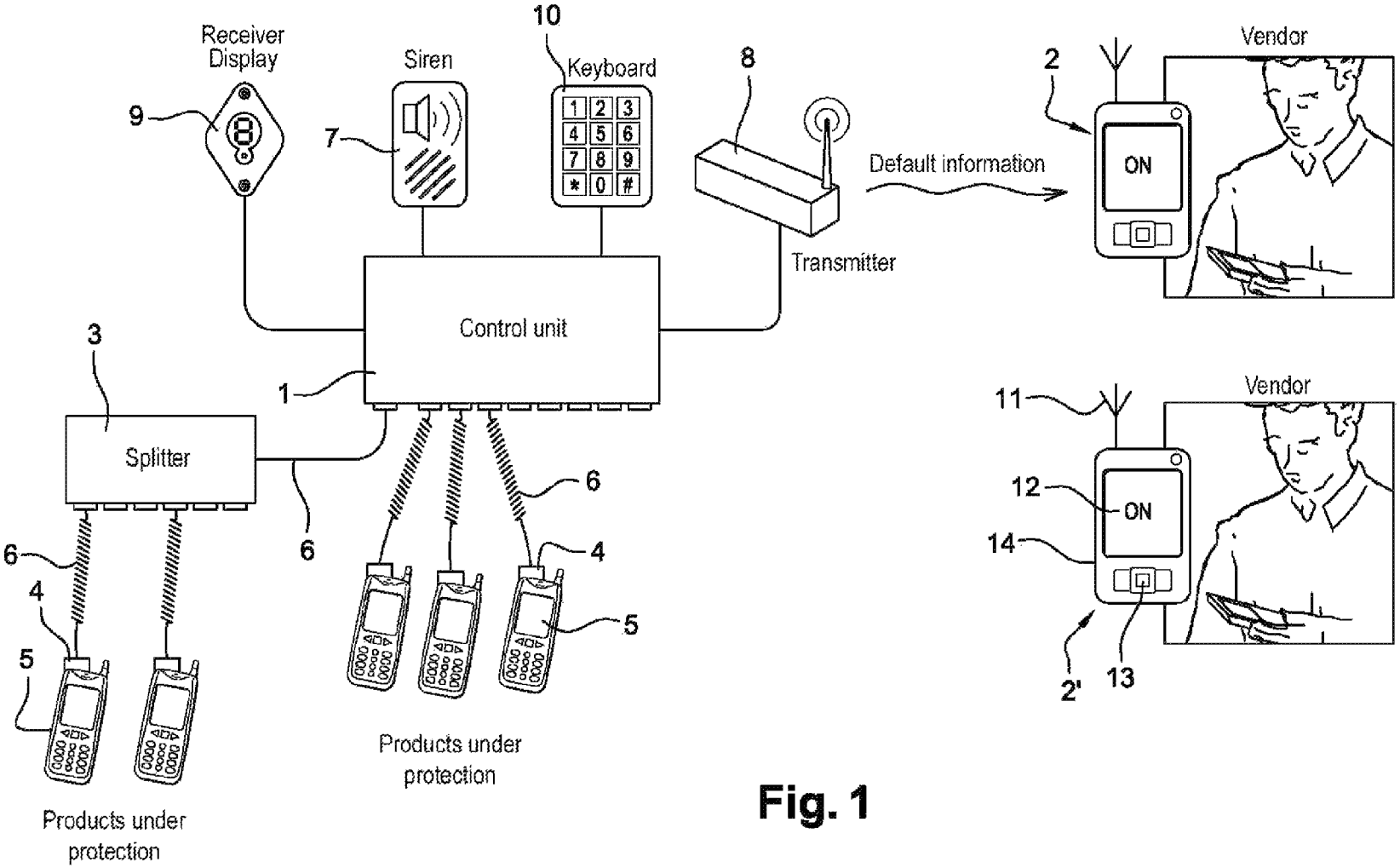

The present invention relates to a silent anti-theft protection system for goods presented to the public. It finds applications in the field of security installations and in particular for consumption article display stands to which consumers have access.

Anti-theft installations are known, which are of the type control unit linked to sensors fixed to goods presented to consumers on one or more display stands. These goods can be manipulated by the consumers for examination or test. Facing accessible goods, consumers are subjected to a strong temptation and some of them could decide to steal the article. Most of them are dissuaded therefrom by the anti-theft installation that is configured to generate an audible alarm signal when there is a theft attempt (including manipulation or vandalism) and/or an actual theft.

The normal handling of the goods causes significant stresses on the sensors and/or the sensor—control unit link, which may result in the sensor unfastening from the article and trigger an alarm. These handling operations may also result with time in bad contacts in the connectors or the sensors—control unit links, which may also be a source of alarm.

Even if the available installations generally have a low rate of untimely triggering of the audible alarm, the fact remains that repeated occurrences thereof may be demotivating for security employees or, more generally, the employees of the place. Indeed, on the one hand, after a number of alarms "for nothing", the employees are no longer motivated to go and see. On the other hand, when an alarm is audible and several employees are liable to respond to it, some of them may think, for any good or bad reason, that another person will go and see, and it may happen that, finally, nobody responds. Moreover, these audible alarms, whatever their causes are, are not reassuring for certain consumers. Finally, as for the ill-intentioned consumers, the existence of an audible alarm may be an interesting source of information regarding the triggering conditions and may help for trying to determine what can be the theft or vandalism actions that do not trigger the alarm.

Therefore, it is advantageous to have available an anti-theft installation that permits to detect thefts and/or other actions prejudicial to the goods or the anti-theft system, and that does not trigger an audible alarm while informing the employees that something abnormal is happening. It is even preferable that the information is personally provided to the employees, so that each employee is personally motivated to react to it. Moreover, by way of security, in case no employee can be informed or even react, it is useful that an audible alarm is finally triggered.

BRIEF SUMMARY OF THE INVENTION

Accordingly, the invention relates to an anti-theft protection system for goods presented to the public, the system comprising a set of sensors connected to the goods presented to the public, the sensors being linked to a control unit, the control unit being capable of determining states regarding the goods, said states being at least a state of presence of the goods and a state of theft attempt and/or actual theft, the shift from a state of presence of the goods to a state of theft attempt and/or actual theft resulting, in the absence of inhibition of the detection for said sensor, in the control unit being set into alarm, said control unit comprising or being connected to a sonorous alarm generating means.

According to the invention, the control unit further comprises wireless transmission-reception means, and the system further comprises at least one portable wireless transmitter-receiver capable of communicating with the wireless transmission-reception means of the control unit, and the system further comprises means:

adapted so that, upon the setting-into-alarm of said control unit, the transmission-reception means of the control unit provide for searching for the functional existence of at least one portable transmitter-receiver, during a determined maximum search time thanks to the sending of a search signal, the functional existence of a portable transmitter-receiver being recognized by the transmission-reception means of the control unit receiving a response sent by said portable transmitter-receiver after the latter has received said search signal, and so that, in the absence of response from at least one portable transmitter-receiver at the end of the determined maximum search time, the control unit activates the sonorous alarm generating means to produce an audible alarm.

In various embodiments of the invention, the following means are used, either alone or in any technically possible combination:

the system comprises several portable transmitters-receivers, the determined maximum search time is comprised between 200 ms and 4 s, the portable transmitter-receiver further comprises a user output interface for informing the user thereof that the control unit has been set into alarm, and said output interface is operated by an alert information transmitted by the control unit to the portable transmitter-receiver, the alert information is dissociated from the search signal, the search signal and the alert information are distinct transmissions, the alert information is associated with the search signal, the search signal comprises the alert information, the search signal being also an alert information, the transmission-reception means of the control unit further transmit to the portable transmitter-receiver an information of activation of the sonorous alarm generating means (to inform the portable transmitter-receiver user that the sonorous alarm means has been activated), and the portable transmitter-receiver further comprises a user output interface for informing said user that the sonorous generating means has been activated, the portable transmitter-receiver further comprises a user output interface for displaying the identification of the sensor(s) whose state has changed, and the system further comprises means for sending from the transmission-reception means of the control unit to the portable transmitter-receiver identification information providing said displaying, equivalently, the identification information relates, additionally or as an alternative, to the goods item(s), the user output interface for displaying the identification is a numeric display screen, for example a series of 7-segments LED or LCD display screens, the user output interface for displaying the identification is an alphanumeric display screen, for example a LCD display screen with 1 or 2 lines of 16 characters, the user output interface for displaying the identification is a graphic display screen, for example an LCD-type matrix display panel for displaying texts and images, as an alternative or in addition, a user output interface of the portable transmitter-receiver provides an auditory indication of the identification by a loud-speaker and a vocal interface, the sensor identification information is transmitted during the search for the functional existence of a portable transmitter-receiver, the sensor identification information is associated with the search signal, the search signal comprises the identification information, the sensor identification information is transmitted after the search for the functional existence of a portable transmitter-receiver when the functional existence of said portable transmitter-receiver has been recognized, the sensor identification information is dissociated from the search signal, the alert information and the identification information are distinct transmissions, the alert information comprises the identification information, the system further comprises means adapted so that, upon the setting-into-alarm of said control unit and after recognition of the functional existence of a portable transmitter-receiver, a pre-alarm timeout (sonorous alarm activation delay) of a predetermined duration is triggered in the control unit, wherein the absence of pre-alarm timeout stopping causes the activation of the sonorous alarm generating means at the end of said pre-alarm timing in order to produce a sonorous alarm, the pre-alarm timeout stopping is operated from the control unit, the pre-alarm timeout stopping is operated from the portable transmitter-receiver, the portable transmitter-receiver further comprises a user input interface for sending command(s) to the control unit, a command that can be sent to the control unit by the portable transmitter-receiver is an order of stopping the pre-alarm timeout, a command that can be sent to the control unit by the portable transmitter-receiver is an order of inhibiting the sonorous generating means (the activation thereof will be impossible), a command that can be sent to the control unit by the portable transmitter-receiver is an order of suppressing the inhibition of the sonorous generating means (the reactivation thereof will be possible), a command that can be sent to the control unit by the portable transmitter-receiver is an order of deactivating the sonorous generating means (the deactivation is effective only if the sonorous generating means was activated), a command that can be sent to the control unit by the portable transmitter-receiver is an order of inhibiting the detection for a given sensor, a command that can be sent to the control unit by the portable transmitter-receiver is an order of suppressing the detection inhibition for a given sensor, the portable transmitter-receiver further comprises a user input interface for sending command(s) to the control unit and the at least one command that can be sent by the portable transmitter-receiver is a command of stopping the pre-alarm timeout, the control unit comprises means for measuring the level of reception of the signal from said recognized portable transmitter-receiver and the predetermined duration of the pre-alarm timeout is a function of the level of reception such that said predetermined duration is different according to the distance of said recognized portable transmitter-receiver, the control unit comprises means for measuring the level of reception of the signal from said recognized portable transmitter-receiver and the predetermined duration of the pre-alarm timeout is a reverse function of the level of reception such that a low reception level, meaning a great distance of said recognized portable transmitter-receiver, results in a longer timeout, the control unit comprises means for measuring the level of reception of the signal from said recognized portable transmitter-receiver and the predetermined duration of the pre-alarm timeout is a direct function of the level of reception such that a low reception level, meaning a great distance of said recognized portable transmitter-receiver, results in a shorter timeout, each of the portable transmitters-receivers has its own identifier, said identifier serving for the identification of the portable transmitters-receivers during wireless exchanges, the system comprises means for searching, by means of a search signal, for portable transmitters-receivers during the determined maximum search time and, in the absence of response at the end of the determined maximum search time, the control unit activates the sonorous alarm generating means to produce an audible alarm, the system comprises means for defining privilege levels corresponding to groups of commands authorized to be executed in the control unit for each portable transmitter-receiver, the functional recognition of a given portable transmitter-receiver is possible only if the latter has a sufficient privilege level, the privilege management is performed in the control unit, said control unit executing or not the received command according to the privilege level of the portable transmitter-receiver that has sent the command, the privilege management is performed in each portable transmitter-receiver, said potable transmitter-receiver being able or not, according to its privilege level, to send a response to a search signal, the privilege management is performed in each portable transmitter-receiver, said potable transmitter-receiver being able or not, according to its privilege level, to send a given command, the privilege management is shared between the control unit and the portable transmitters-receivers, the transmission-reception means of the control unit and of the portable transmitter-receiver comprise means for securing the wireless exchanges between each other, said securing means being chosen from one or more of the following means: encryption of the data exchanged, sending of an identifier, the data (notably the response to a search signal or a command) sent by the portable transmitter-receiver are encrypted as a function of the identifier thereof (the identifier thereof, or data comprising the identifier or calculated based on the identifier), the data sent by the portable transmitter-receiver are encrypted as a function of data transmitted by the control unit during the search, the data sent by the portable transmitter-receiver are encrypted as a function of data transmitted by the control unit during the search and of its own identifier, the wireless exchanges are encrypted, the activation of a portable transmitter-receiver can only be made if a password is input in said portable transmitter-receiver and is recognized as being valid, the transmission-reception means of the control unit provide, in addition or as an alternative, for periodically performing, independently from any setting-into-alarm, a search for the functional existence of at least one portable transmitter-receiver during a maximum search duration predetermined thanks to the sending of a search signal, the functional existence of a portable transmitter-receiver being recognized by the transmission-reception means of the control unit receiving a response sent by said portable transmitter-receiver after the latter has received said search signal, such that, upon a later setting-into-alarm, the control unit already knows the functional portable transmitter(s)-receiver(s), the search time (upon a setting-into-alarm) is identical to the search duration (for a periodical search independent from any setting-into-alarm), the search duration is longer than the search time, the periodicity is longer than the search duration, the periodicity is longer than or equal to 5 seconds, the periodicity is comprised between 5 seconds and 3 minutes, in the case of a periodical search, independent from any setting-into-alarm, for the functional existence of at least one portable transmitter-receiver, upon the setting-into-alarm, if the control unit knows, as a result of the last periodical search, at least one portable transmitter-receiver that functionally exists, then the system does not perform a new search for the functional existence of at least one portable transmitter-receiver, and the pre-alarm timeout is immediately triggered, in the case of a periodical search, independent from any setting-into-alarm, for the functional existence of at least one portable transmitter-receiver, upon the setting-into-alarm, if the control unit knows, as a result of the last periodical search, at least one portable transmitter-receiver that functionally exists, then the system immediately performs a new search for the functional existence of at least one portable transmitter-receiver, during the determined maximum search time, and, in the absence of response from a portable transmitter-receiver at the end of the determined maximum search time, the control unit activates the sonorous alarm generating means to produce an audible alarm, in the case of a periodical search, independent from any setting-into-alarm, for the functional existence of at least one portable transmitter-receiver, upon the setting-into-alarm, if the control unit does not know, as a result of the last periodical search, any portable transmitter-receiver that functionally exists, then the system does not perform a new search for the functional existence of at least one portable transmitter-receiver and, in this case, the sonorous alarm generating means is immediately activated upon the setting-into-alarm, in the case of a periodical search, independent from any setting-into-alarm, for the functional existence of at least one portable transmitter-receiver, upon the setting-into-alarm, if the control unit does not know, as a result of the last considered search, any portable transmitter-receiver that functionally exists, then the system immediately performs a new search for the functional existence of at least one portable transmitter-receiver, during the determined maximum search time, and, in the absence of response from a portable transmitter-receiver at the end of the determined maximum search time, the control unit activates the sonorous alarm generating means to produce an audible alarm, the transmission-reception means are of the short-distance local type, wherein the control unit and the portable transmitter-receiver are able to communicate within a range of about one hundred metres at most, in open ground, the transmission-reception means are radiofrequency means, the radiofrequency transmission-reception means are of the BLUETOOTH® type, the radiofrequency transmission-reception means are of the ZIGBEE® type, the radiofrequency transmission-reception means are of the WIFI® type, the transmission-reception means are infrared means, the sonorous alarm generating means are further coupled to visual alarm generating means, the sonorous and visual means being activated at the same time, the sonorous and/or visual alarm generating means are inside the control unit, the sonorous and/or visual alarm generating means are deported from the control unit, the portable transmitter-receiver is a portable cellular phone further comprising a short-distance radio communication means, the portable transmitter-receiver is a portable cellular phone further comprising a short-distance radio communication means of the BLUETOOTH® type, the portable transmitter-receiver is a portable game console further comprising a short-distance radio communication means, the portable transmitter-receiver is a portable game console further comprising a short-distance radio communication means of the ZIGBEE® type, the portable transmitter(s)-receiver(s) are portable phone(s), the control unit being linked to the fixed telephone network to join the portable phone(s) or comprising transmission-reception means compatible with a wireless telephone network, the portable transmitter-receiver is a self-powered apparatus (with a rechargeable battery or cell) with at least a keyboard and a display screen, the portable transmitter-receiver comprises a bell and/or a buzzer.

The invention also relates to a portable transmitter-receiver that is specially configured for the system of the invention and that can have one or several of the mentioned characteristics.

The invention also relates to a control unit that is specially configured for the system of the invention and that can have one or several of the mentioned characteristics.

Therefore, the invention relates to a silent alarm, silent meaning that the sonorous alarm will not be immediately triggered (audible alarm) by the control unit in case of theft attempt and/or actual theft if a portable transmitter-receiver is recognized as being functionally active/present in the surroundings of the control unit. A timeout delaying the sonorous alarm triggering may even be stopped by an active portable transmitter-receiver, which will prevent any audible alarm.

BRIEF DESCRIPTION OF THE SEVERAL VIEWS OF THE DRAWING(S)

The present invention will now be exemplified, without thereby being limited, by the following description of an embodiment, in relation with:

FIG. 1, which schematically shows a system according to the invention, and

Figure 2:
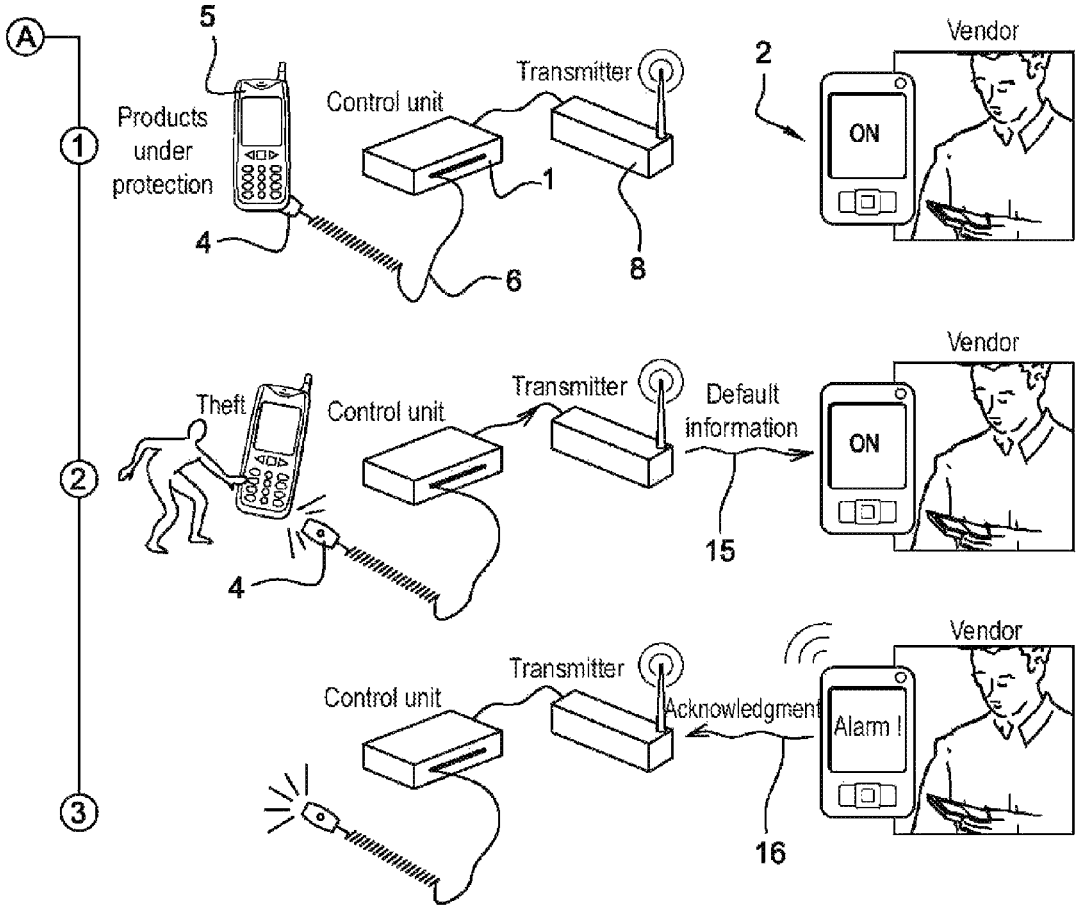
Figure 3:
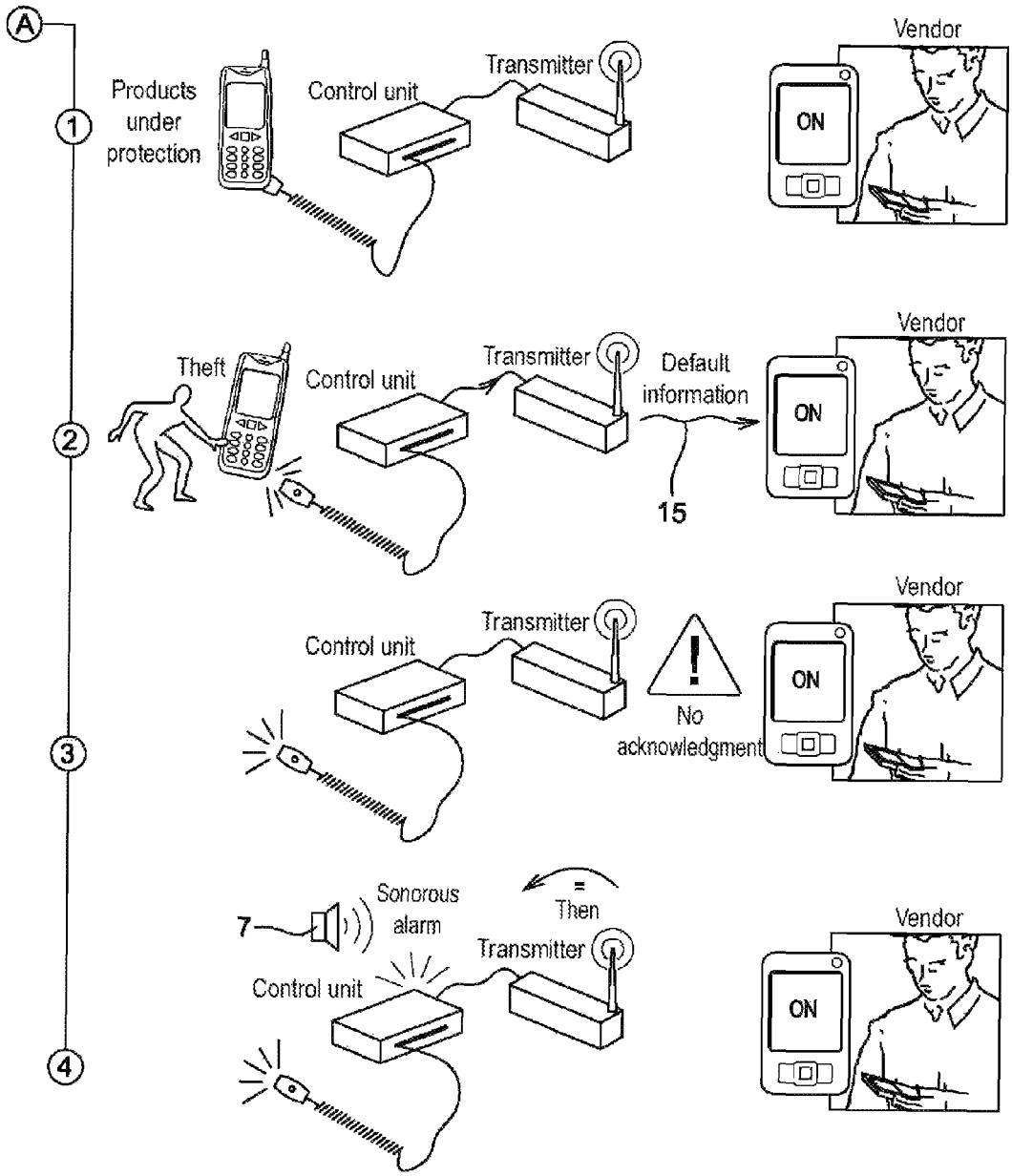

FIGS. 2 and 3, which schematically show different states of operation of a system according to the invention.

In FIG. 1, the system essentially comprises a fixed control unit 1 linked to sensors 4 connected to goods 5 (for example, portable phones exposed on a display stand) and at least one, herein two, portable transmitters-receivers 2 and 2', held by two vendors/users. The control unit 1 is linked by wire 6, either directly to the sensors 4 or indirectly through a splitter 3. It is understood that, for the sensors—control unit links, any type of topology is possible within the framework of the invention, as well as any type of link, whether it is wire-based, as shown, or radio- or infrared-based. Moreover, any type of sensor can be used: contact, remote, mechanical switch, electronic, analog or digital type . . . . It is sufficient that the control unit can at least detect a goods theft attempt and/or actual theft, which corresponds to a changing of state in this control unit—sensors part of the system. Conventionally, the control unit 1 comprises a display screen 9 that can be an external device as shown (or located on the control unit) and that is intended to display information, and an optional keyboard 10 that is intended for inputting information. The control unit also comprises one (or several) sonorous alarm generating means 7, of the siren type, which is herein an external device and which can be activated to produce an alarm audible sound. This control unit comprises electronic means, notably such as a microcontroller or microprocessor with an operating program. The control unit further comprises internal or external wireless transmission-reception means 8 for remote communication, herein by radiofrequency waves, with portable transmitters-receivers 2 and 2'.

Herein, the portable transmitters-receivers 2 and 2' are stand-alone dedicated devices comprising radio means 11, a visual output interface 12 in the form of a display screen, a sonorous output interface 14 in the form of an infra-audible buzzer and/or a loud-speaker and/or an audible buzzer, and a input interface 13 in the form of a keyboard or, in the case of a graphical display screen, a touch pad. These portable transmitters-receivers comprise electronic circuits, preferably of the programmable type. In other alternatives, the transmitters-receivers, which may or not all be of the same type, are simplified with only the radio means 11 and a sonorous output interface or, on the contrary, they comprise other devices providing complementary functions, for example a reader for smart cards or for CF or SD-type memory cards, etc., as in the case of a portable phone. In case the portable transmitter-receiver is a portable phone or a portable game console, it is well understood that it then comprises software means intended to operate in the system of the invention.

DETAILED DESCRIPTION OF THE INVENTION

In this example, the control unit is a dedicated equipment. In other embodiments, it may be a micro-computer with a keyboard and a display screen linked to an external module, itself linked to the sensors. In the case of a micro-computer, the external module may be replaced by a card plugged inside the micro-computer. The transmission-reception means may then be located on the plugged card or they may use a pluggable generic radio card or a generic radio electronic key ("dongle"), for example BLUETOOTH®, ZIGBEE® or WIFI®.

In operation, distinct transmissions of data may be implemented for the search signal (for knowing that a portable transmitter-receiver is functionally present if the latter responds), the alert information (for informing the portable transmitter-receiver user that the control unit has been set into alarm, typically by activation of a sonorous means of the portable transmitter-receiver), and the sensor identification information (for informing the portable transmitter-receiver user about the concerned sensors/goods, typically by displaying on the portable transmitter-receiver). In other embodiments, the data can be combined within a same transmission, for example the search signal and the sensor identification information can be associated together within a single transmission. Likewise, the number of transmissions and the quantity of transmitted data can be reduced because the functions corresponding to such data can be associated together, for example only are transmitted sensor identification information serving for the search (as would have provide the search signal), for the setting-into-alarm information (as would have provide the alert information) and for the sensor(s) or goods item(s) identification information.

The basic operation of the system in silent alarm will now be described.

In operation, the control unit is programmed to monitor the state of the sensors 4 and, in advanced versions, of the wire lines 6 (against the wire line manipulation attempts). Only the sensors for which a monitoring is desired, in practice those which are connected to goods to protect against theft, are monitored, the other ones being inhibited (not monitored). Therefore, only the sensors that are not inhibited can cause the setting-into-alarm of the control unit upon a state changing toward a goods theft attempt and/or actual theft.

In the normal condition corresponding to State A1 in FIG. 2 or State B1 in FIG. 3, the goods are connected to their respective sensor and the corresponding state of the sensor (in practice of the corresponding input of the control unit) is normal. In case of theft attempt and/or actual theft corresponding to State A2 in FIG. 2 and State B2 in FIG. 3, which typically causes the separation of the sensor from the goods item, the state of the sensor changes, which causes the setting-into-alarm of the control unit. This setting-into-alarm is silent and causes the activation of the transmission-reception means 8 for the search for at least one portable transmitter-receiver that is functional. The control unit thus transmits a search signal in the form of a default information 15 that a portable transmitter-receiver will be able to receive if it is functional and in the radio covering area of the system in which radio exchanges are possible between the control unit and the portable transmitter(s)-receiver(s). When a portable transmitter-receiver receives this search signal, which corresponds to State A3 in FIG. 2, it responds to the control unit, by an acknowledgment 16, to inform the latter that it is available and functional. It then results in that the control unit succeeds in determining the functional existence of a portable transmitter-receiver. Such search by the control unit must lead to the determination of the functional existence of a portable transmitter-receiver within a determined maximum search time after the control unit has been set into alarm.

If at the end of this determined maximum search time the functional existence of a portable transmitter-receiver has not been determined, which corresponds to State B3 in FIG. 3 (no response has been received from a portable transmitter-receiver in connection with an acknowledgment of the search signal), then the sonorous alarm generating means is activated, which causes the audible emission of a siren sound or alarm bell, or even the generation of a synthetic voice indicating the goods item that is concerned or any other speech liable to cause surprise of the thief, which corresponds to State B4 in FIG. 3. Typically, the determined maximum search time is relatively short, and at most of a few seconds. Preferably, the search is stopped as soon as a portable transmitter-receiver is found. In alternatives, the search is performed during the whole determined maximum search time and possibly several transmitters-receivers can be found.

To inform the user (vendor), the portable transmitter-receiver thereof comprises a user output interface for informing him/her about the setting-into-alarm of the control unit, for example a sonorous interface 14 by a bell, a buzzer . . . . For that purpose, the control unit sends, by wireless transmission, an alert information that operates said output interface. The alert information may be associated with the search signal or dissociated from the latter.

It is to be noted that, during the search, the search signal or the alert information transmitted by the control unit may further contain information for identifying the concerned sensor(s) and/or goods item(s). If it is not the case, a later transmission from the control unit, after a positive determination of the functional existence of a portable transmitter-receiver, of information for identifying the concerned sensor(s) and/or goods item(s) may be performed. It is interesting only if it is desired to inform the portable transmitter-receiver user and if the latter has ad hoc output interface means allowing this effective information, as the display screen 12 for example.

It is understood that if several portable transmitters-receivers can be used in the system, the control unit can be programmed so as to stop the search as soon as the first functionally existent portable transmitter-receiver has been found or to continue the search for others portable transmitters-receivers during the determined maximum search time, only one portable transmitter-receiver found functionally existent (and, moreover, possibly, with an authorized identifier and/or a sufficient privilege) being sufficient to prevent the activation of the sonorous alarm generating means at this stage (at the end of the predetermined search time). Moreover, identifiers and/or privileges can be associated with the portable transmitters-receivers and the searches and/or later actions can be performed according to the identifiers and/or privileges of said portable transmitters-receivers: for example, to be recognized as being functionally present, the portable transmitter-receiver will need to have a sufficient privilege.

Although the portable transmitter(s)-receiver(s) that has (have) responded (and that is(are) thus considered as being functionally present, taking into account the possible privileges and/or identifiers) has(have) activated means for informing the user thereof (vendor) about a theft (from a mere bell ring to the displaying of the concerned sensor/goods item), it is not certain that the user has been actually informed (for example, the user may have temporarily part with his/her portable transmitter-receiver) or even that he/she can do something. It is thus preferable that an additional security is present in case nobody can do something. This additional security consists in activating the sonorous alarm generating means at the end of a pre-alarm timeout of a predetermined duration in the control unit, if this timeout has not been stopped meanwhile. Therefore, at the end, an audible alarm will be produced by the sonorous generating means of the control unit, for finally warning any person in the surroundings if the pre-alarm temporization has not been stopped.

In an alternative, the control unit comprises means for measuring the level of reception of the signal from the recognized portable transmitter-receiver and the predetermined duration of the pre-alarm timeout is a function of the level of reception such that said predetermined duration is different according to the distance of said recognized portable transmitter-receiver. It is understood that, for that purpose, the transmission power of the portable transmitter-receiver has to be substantially constant so that the level of reception can be liken to the distance between the control unit and said portable transmitter-receiver. In an alternative, different power levels can be provided, but in this case, the control unit has to be informed of that, for example by the portable transmitter-receiver sending to the control unit information about its current transmission power level when a changing occurs or at each transmission, so that the control unit can take it into account.

In an alternative, the control unit comprises means for measuring the level of quality of the radio exchanges and, when this level goes below a determined threshold, the system goes into a mode of immediate activation of the sonorous generating means when the control unit is set into alarm or is already in alarm state (if in pre-alarm timeout state).

In an alternative embodiment, the search for portable transmitter(s)-receiver(s) by the control unit can be performed on a periodical basis, independently from any setting-into-alarm. Therefore, the control unit can know in advance, at the time of a setting-into-alarm, what is(are) the portable transmitter(s)-receiver(s) that is(are) functionally present, which can avoid the need to perform a new search. However, if no new search is performed upon the setting-into-alarm, it is then preferable that the pre-alarm timeout triggers immediately, in case the portable transmitter-receiver has become inactive since the last periodical search. This alternative also permits a time tracking of the presence or not of the portable transmitters-receivers and thus of the users thereof. Therefore, the transmission-reception means of the control unit perform on a periodical basis a search for the functional existence of at least one portable transmitter-receiver, during a determined search duration. The functional existence of a portable transmitter-receiver is recognized by the transmission-reception means of the control unit receiving a response sent by said portable transmitter-receiver to said search. In the absence of response at the end of the determined search duration, the control unit considers that there is no portable transmitter-receiver and, in the presence of one or several responses during the determined search duration, the control unit considers that said portable transmitter(s)-receiver(s) that has (have) responded is(are) functionally existent.

It has been seen that the invention essentially relates to the silent alarm and wireless transmission part. The portable transmitter-receiver, besides its functionalities and basic means for its application within the invention, may comprise additional functionalities such as means for remote programming (sensors inhibition—uninhibition, configuration commands . . . ) or else. It is understood that the described means can be combined with means that do not use wireless transmission and/or providing a non-silent alarm. In the first case, for example, the stopping of the pre-alarm timeout may be further performed by a button or by an action on the keyboard of the control unit. It may be the same for other commands or actions that can be operated directly on the control unit. In the second case, for example, a more conventional operation with immediate activation of the sonorous generating means upon the setting-into-alarm may be chosen. The system has been generally presented as comprising some sensors and a control unit. However, it is well understood that the invention also applies to more complex structures comprising, for example, splitters, deported control means, dedicated control unit or in the form of a micro-computer . . . . The links between the sensors and the control unit may be of any type: wire-based or wireless, analog or not . . . . The transmission-reception means of the control unit may be integrated in said unit or be remotely, physically separated therefrom. In an alternative, the pre-alarm timeout is triggered as soon as the control unit is set into alarm, but the pre-alarm timeout duration is longer than the maximum search time so as to leave the system the time to search for and find a potential functional portable transmitter-receiver. Finally, in an alternative, the link between the control unit and the portable transmitter(s)-receiver(s) is not direct by the wireless transmission-reception means of the control unit but passes through a wireless public telephone network, the control unit being radio-linked or wire-linked to the telephone network and being capable of calling on the network one or the portable transmitter(s)-receiver(s) that are herein typically portable phones.

The invention claimed is:

1. An anti-theft protection system for goods presented to the public, the system comprising a set of sensors (4) connected to the goods (5) presented to the public, the sensors being linked to a control unit (1), the control unit being capable of determining states regarding the goods, said states being at least a state of presence of the goods and a state of theft attempt and/or actual theft, the shift from a state of presence of the goods to a state of theft attempt and/or actual theft resulting, in the absence of inhibition of the detection for said sensor, in the control unit being set into alarm, said control unit comprising or being connected to a sonorous alarm generating means (7), characterized in that the control unit further comprises wireless transmission-reception means (8), and the system further comprises at least one portable wireless transmitter-receiver (2, 2') capable of communicating (11) with the wireless transmission-reception means (8) of the control unit, and in that the system further comprises means adapted so that, upon the setting-into-alarm of said control unit, the transmission-reception means of the control unit provide for searching for the functional existence of at least one portable transmitter-receiver, during a determined maximum search time thanks to the sending of a search signal, the functional existence of a portable transmitter-receiver being recognized by the transmission-reception means of the control unit receiving a response sent by said portable transmitter-receiver after the latter has received said search signal, and so that, in the absence of response from at least one portable transmitter-receiver at the end of the determined maximum search time, the control unit activates the sonorous alarm generating means to produce an audible alarm.

2. A system according to claim 1, characterized in that the portable transmitter-receiver further comprises a user output interface (14) for informing the user thereof that the control unit has been set into alarm, and said output interface is operated by an alert information transmitted by the control unit to the portable transmitter-receiver.

3. A system according to claim 2, characterized in that the portable transmitter-receiver further comprises a user output interface (12) for displaying the identification of the sensor(s) whose state has changed, and in that the system further comprises means for sending from the transmission-reception means of the control unit to the portable transmitter-receiver identification information providing said displaying.

4. A system according to claim 1, characterized in that the portable transmitter-receiver further comprises a user output interface (12) for displaying the identification of the sensor(s) whose state has changed, and in that the system further comprises means for sending from the transmission-reception means of the control unit to the portable transmitter-receiver identification information providing said displaying.

5. A system according to claim 1, characterized in that the system further comprises means adapted so that, upon the setting-into-alarm of said control unit and after recognition of the functional existence of a portable transmitter-receiver, a pre-alarm timeout of a predetermined duration is triggered in the control unit, wherein the absence of pre-alarm timeout stopping causes the activation of the sonorous alarm generating means at the end of said pre-alarm timing in order to produce a sonorous alarm.

6. A system according to claim 5, characterized in that the portable transmitter-receiver further comprises a user input interface (13) for sending command(s) to the control unit, wherein at least one of the commands that can be sent by the portable transmitter-receiver is an order of stopping the pre-alarm timeout.

7. A system according to claim 6, characterized in that the control unit comprises means for measuring the level of reception of the signal from said recognized portable transmitter-receiver and the predetermined duration of the pre-alarm timeout is a function of the level of reception such that said predetermined duration is different according to the distance of said recognized portable transmitter-receiver.

8. A system according to claim 5, characterized in that the control unit comprises means for measuring the level of reception of the signal from said recognized portable transmitter-receiver and the predetermined duration of the pre-alarm timeout is a function of the level of reception such that said predetermined duration is different according to the distance of said recognized portable transmitter-receiver.

9. A system according to claim 1, characterized in that the system comprises several portable transmitters-receivers, each of said portable transmitters-receivers having its own identifier, said identifier serving for the identification during wireless exchanges, and in that, upon the setting-into-alarm, the system comprises means for searching, by means of a search signal, for portable transmitters-receivers during the determined maximum search time, and in that, in the absence of response at the end of the determined maximum search time, the control unit activates the sonorous alarm generating means to produce an audible alarm.

10. A system according to claim 9, characterized in that the system comprises means for defining privilege levels corresponding to groups of commands authorized to be executed in the control unit for each identified portable transmitter-receiver.

11. A system according to claim 1 characterized in that the transmission-reception means are of the short-distance local type, wherein the control unit and portable transmitter-receiver are able to communicate within a range of about one hundred meters at most, in open ground.

12. A system according to claim 1, characterized in that the transmission-reception means of the control unit comprise, in addition or as an alternative, means for periodically performing, independently from any setting-into-alarm, a search for the functional existence of at least one portable transmitter-receiver during a determined search duration thanks to the sending of a search signal, the functional existence of a portable transmitter-receiver being recognized by the transmission-reception means of the control unit receiving a response sent by said portable transmitter-receiver after the latter has received said search signal, such that, upon a later setting-into-alarm, the control unit already knows the functional portable transmitter(s)-receiver(s).

* * * * *